United States Patent [19]

Jones

[11] Patent Number: 5,011,143

[45] Date of Patent: Apr. 30, 1991

[54] TENNIS TRAINING DEVICE

[76] Inventor: Raymond Jones, 2 Loombah Avenue, Lindfield, New South Wales, Australia

[21] Appl. No.: 340,177

[22] PCT Filed: Jul. 18, 1988

[86] PCT No.: PCT/AU88/00260

§ 371 Date: Apr. 12, 1989

§ 102(e) Date: Apr. 12, 1989

[87] PCT Pub. No.: WO89/00441

PCT Pub. Date: Jan. 26, 1989

[30] Foreign Application Priority Data

Jul. 16, 1987 [AU] Australia ..... PI3151

[51] Int. Cl.[5] ..... A63B 61/00

[52] U.S. Cl. ..... 273/29 A

[58] Field of Search ..... 273/29 A, 29 R, 185 D, 273/1.5 A, 185 C, 26 E, 200 R, 200 A, 200 B, 58 C, 197 R, 197 A, 184 B, 199 R, 199 A

[56] References Cited

U.S. PATENT DOCUMENTS

| | | | |
|---|---|---|---|
| 2,305,187 | 12/1942 | Neiden | 273/29 A |
| 3,366,389 | 1/1968 | Murray | 273/200 B |
| 3,940,132 | 2/1976 | Lipatto | 273/29 A |
| 3,948,517 | 4/1976 | Feiler | 273/29 A |
| 4,023,798 | 5/1977 | Pronin | 273/29 A |
| 4,049,266 | 9/1977 | Feiler | 273/29 A |
| 4,089,521 | 5/1978 | Berst et al. | 273/29 A |
| 4,105,203 | 8/1979 | Cho | 273/29 A |
| 4,141,550 | 2/1979 | Denizman | 273/29 A |
| 4,191,372 | 3/1980 | Keller | 273/29 A |
| 4,194,735 | 3/1980 | Wilson | 273/26 R |
| 4,269,410 | 5/1981 | Martin | 273/29 A |
| 4,502,685 | 3/1985 | Phillips et al. | 273/29 A |
| 4,508,340 | 4/1985 | Liao | 273/29 A |
| 4,555,110 | 11/1985 | Hai-Ping | 273/200 B |
| 4,793,612 | 12/1988 | Hammond | 273/26 E |

*Primary Examiner*—Theatrice Brown

*Attorney, Agent, or Firm*—Beveridge, DeGrandi & Weilacher

[57] ABSTRACT

A tennis serve training device having a height adjustment secured to a tennis court post by brackets. A target support arm extends horizontally from the upper end from the post and attached thereto by an elastic strap hinge. A target is attached to the outer end of the support arm and when struck by a racket will cause the support arm to swing in a horizontal plane and come to rest in its original position. A foot mat is placed beneath the target as a reference point for a player to stand for a proper position when hitting the target in preparation to practice hitting a serve.

9 Claims, 5 Drawing Sheets

TENNIS TRAINING DEVICE

FIELD OF INVENTION

This invention relates to training devices for ball games such as tennis. For the sake of convenience, the invention will be described in relation to a training device for practising tennis serves but it is to be understood that the invention is not limited thereto.

BACKGROUND ART

Hitherto, the tennis serve has been practised by merely serving a large number of balls on a court. The drawback to such a training method is that the player is not encouraged to correct any defect in his serving action which should be to reach upward and outward to stike the ball. Furthermore, practising ball placement for the serve is made difficult because there is no reference point against which to gauge the height and position of the ball in the air in relation to where the player's feet are placed.

DISCLOSURE OF THE INVENTION

According to the invention there is provided a device for practising a racquet shot and a ball placement comprising a first support member, a second support member extending from the first support member, hinge means connecting the second support member to the first support member and target means on the second support member, the arrangement being such that when the target means is struck by a racquet, the second support member will pivot about the hinge means and then return to its original position.

The target means in its stationary position will act as a reference point in space for which to aim the ball in order to establish the correct height and the correct location in relation to the player's front foot when standing on the foot mat which has been positioned correctly in relation to the target means.

When adapted for practising a tennis serve, the first support member is a height adjustable upright and the second support member extends substantially horizontally from the upright.

BRIEF DESCRIPTION OF THE DRAWINGS

In order that the invention may be more readily understood and put into practical effect, reference will now be made to the accompanying drawings in which.

DESCRIPTION OF PREFERRED EMBODIMENT

Figure 1:
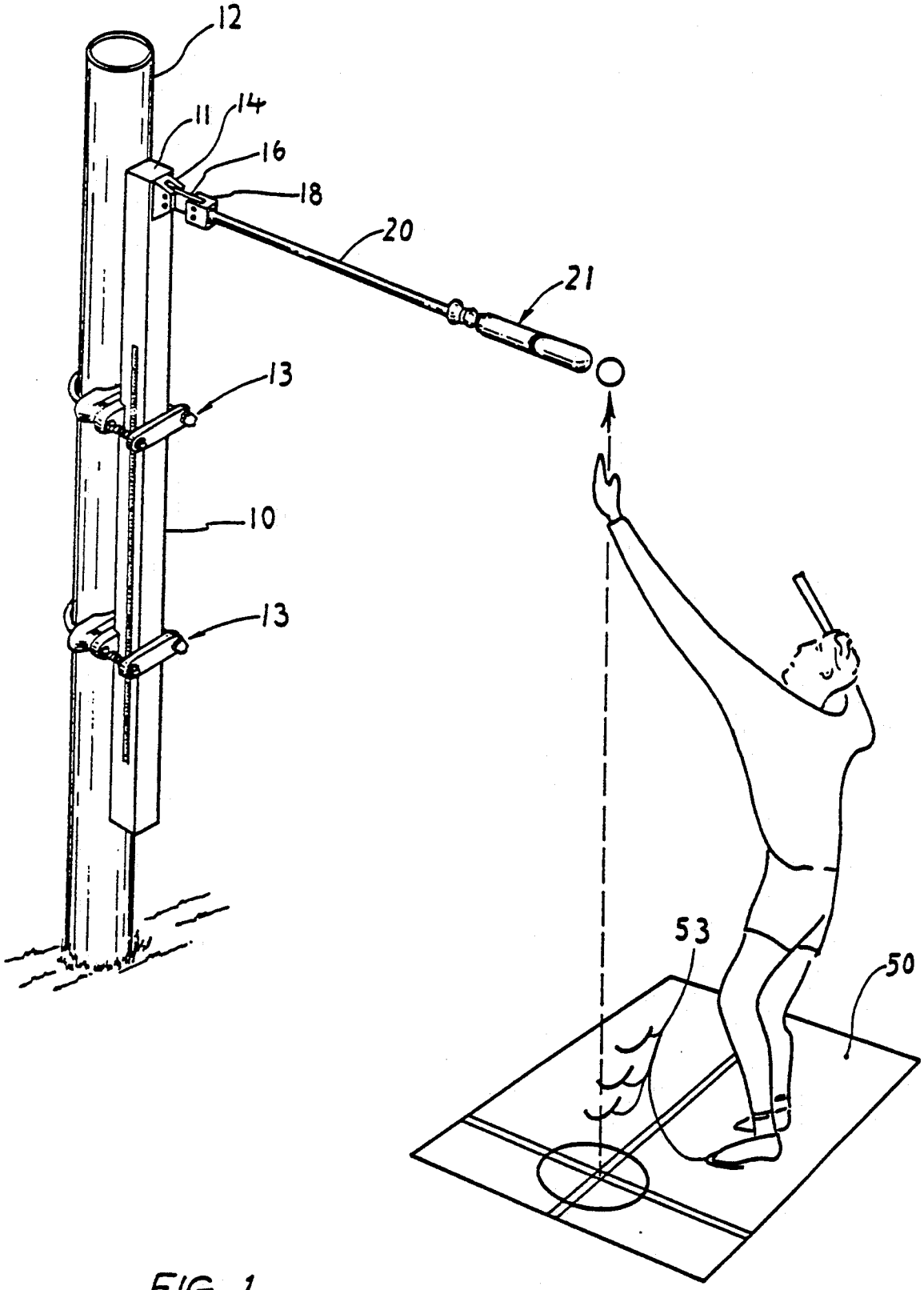
FIG. 1 is a perspective view of a training device according to one embodiment of the invention.
Figure 2:
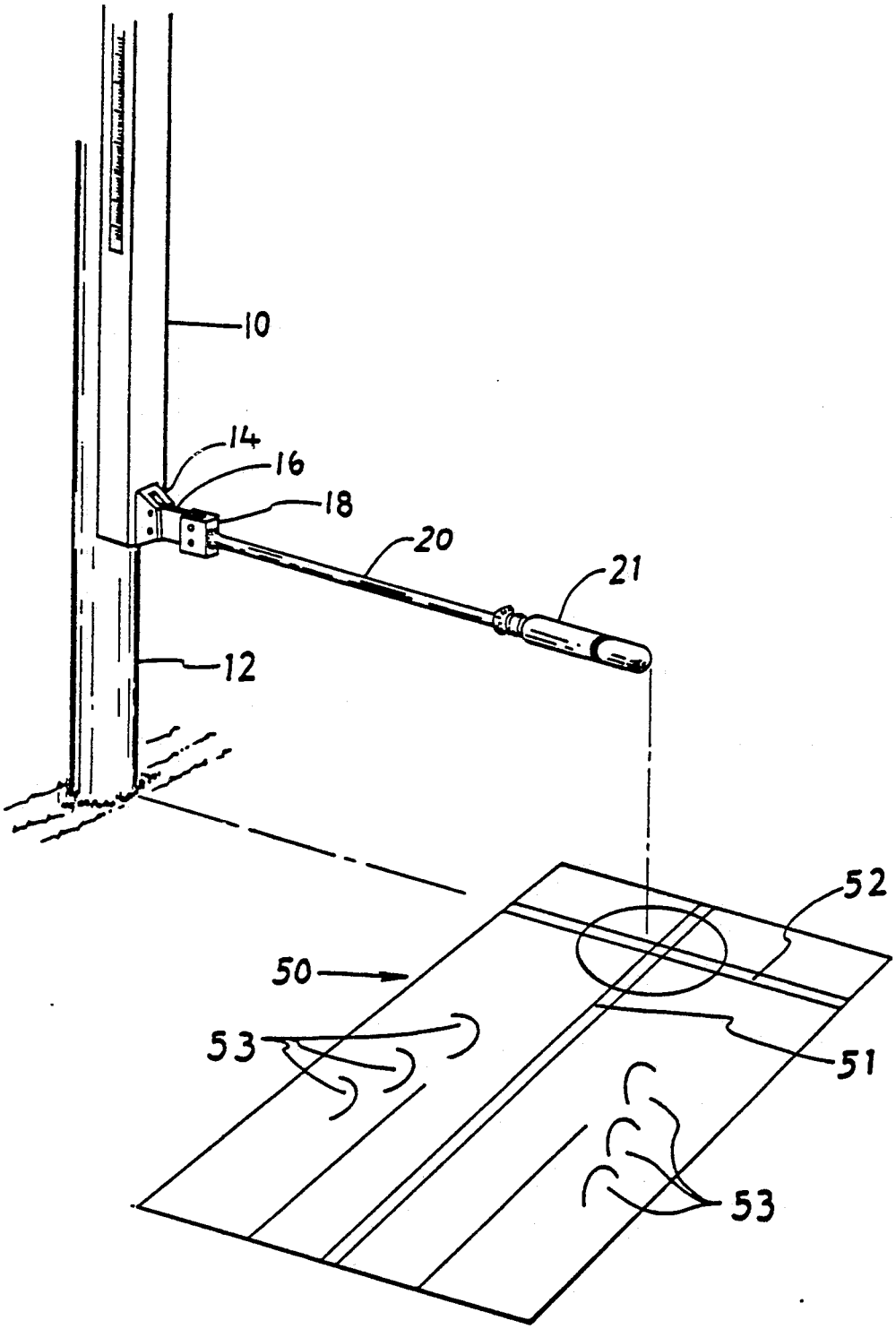
FIG. 2 is a perspective view of the device of FIG. 1 inverted whilst a foot- mat is positioned.
Figure 3:
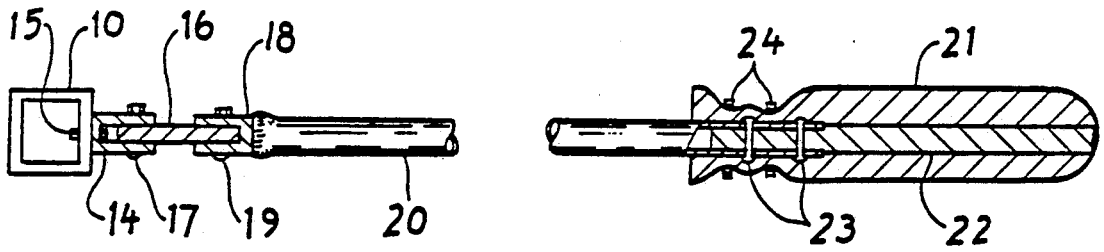
FIG. 3 is a partly cutaway, partly sectioned plan view of the device shown in FIG. 1.
Figure 4:
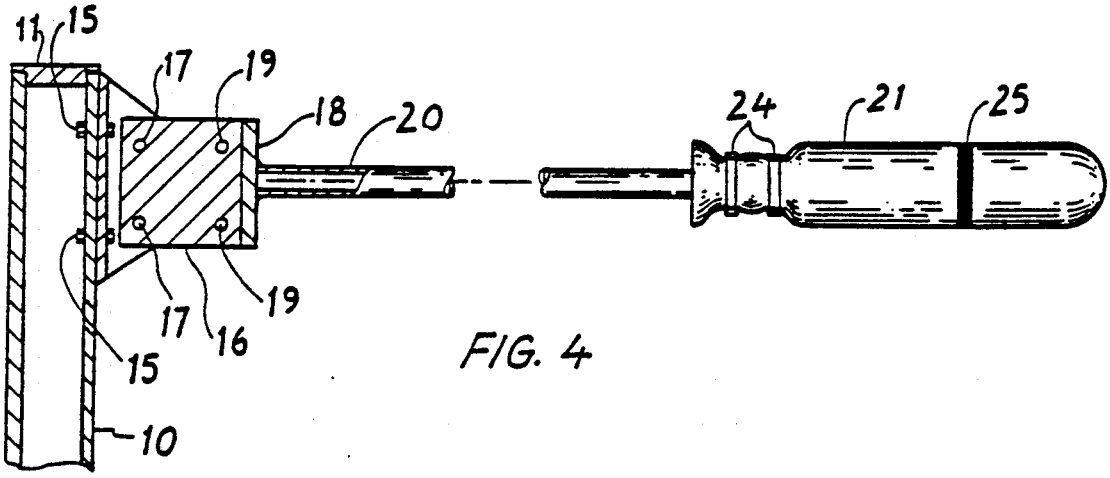
FIG. 4 is a partly cutaway, partly sectioned front elevational view of the device shown in FIG. 1.
Figure 5:
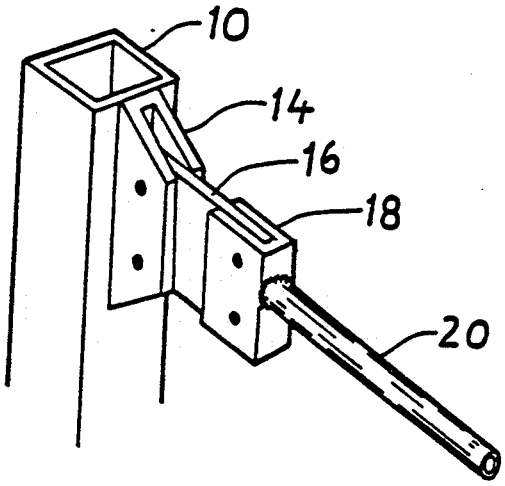
FIG. 5 is an enlarged perspective view of the hinge arrangement of the device shown in FIG. 1.

The tennis serve training device shown in FIGS. 1 to 5 includes an upright 10 which, in this instance comprises a tubular post of rectangular cross-section the top end of which is closed by a cap 11 as shown in FIG. 1. The cap has been removed in FIG. 5. The upright 10 is secured to any convenient support 12, such as a post of a tennis court, by a pair of clamps 13 which are shown in detail in FIGS. 6 to 8 or attaching to a wooden post, or wall by appropriate means.

Adjacent the top of the upright 10 there is a channel bracket 14 that is secured to the upright 10 by belts 15. The channel of the bracket 14 receives one end of a hinge piece 16 make of an appropriate material such as polypropylene. The hinge piece 16 is secured to the mounting or bracket 14 by bolts 17.

The other end of the hinge piece 16 is secured to a second bracket 18 by bolts 19. The second mounting or bracket 18 is rigid with a support arm 20 that extends substantially horizontally from the upright 10. At an outer end of the support arm 20 there is a target means 21 mounted on a flexible nylon or similar material target support 22 that projects into the arm 20 (see FIG. 3) and is secured thereto by bolts 23.

The target means 21 may be of any convenient shape and may be made of any suitable material such as polyurethane foam. The target 21 is held in position on the support 20 by clamps 24. A target line 25 may be printed or painted on the target 21.

Figure 6:
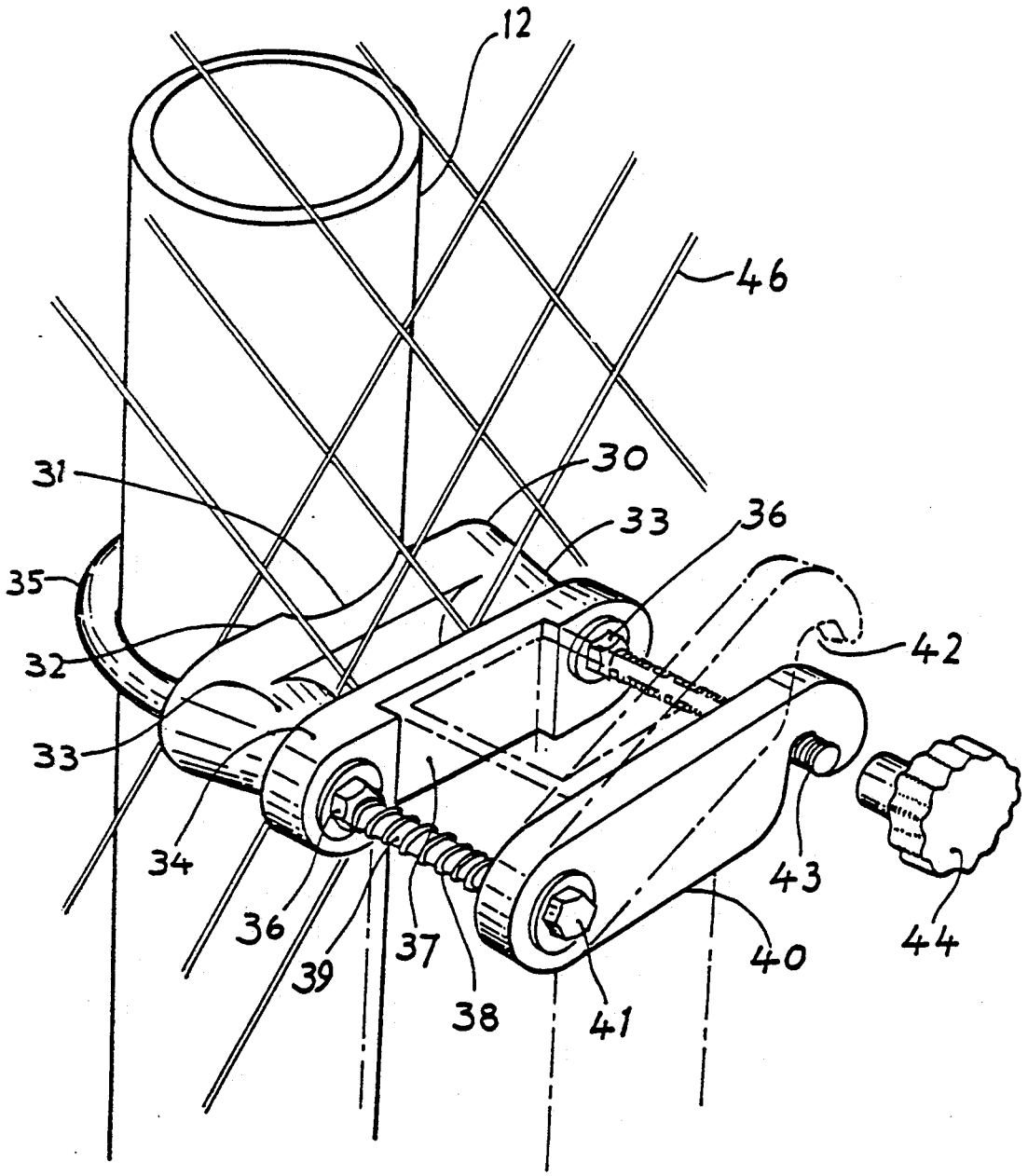
FIG. 6 is a perspective view of a clamp for securing the device of FIG. 1 to a post.
Figure 7:
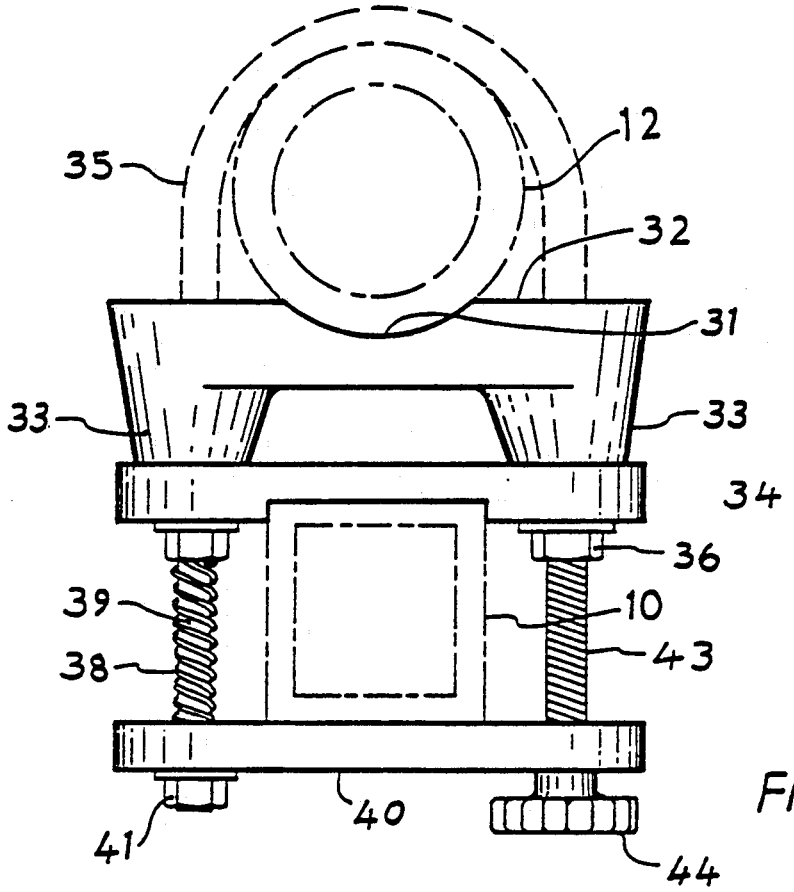
FIG. 7 is a plan view of the clamp shown in FIG. 6, and, FIG. 8 is a front elevational view of the clamp shown in FIG. 6.
Figure 8:
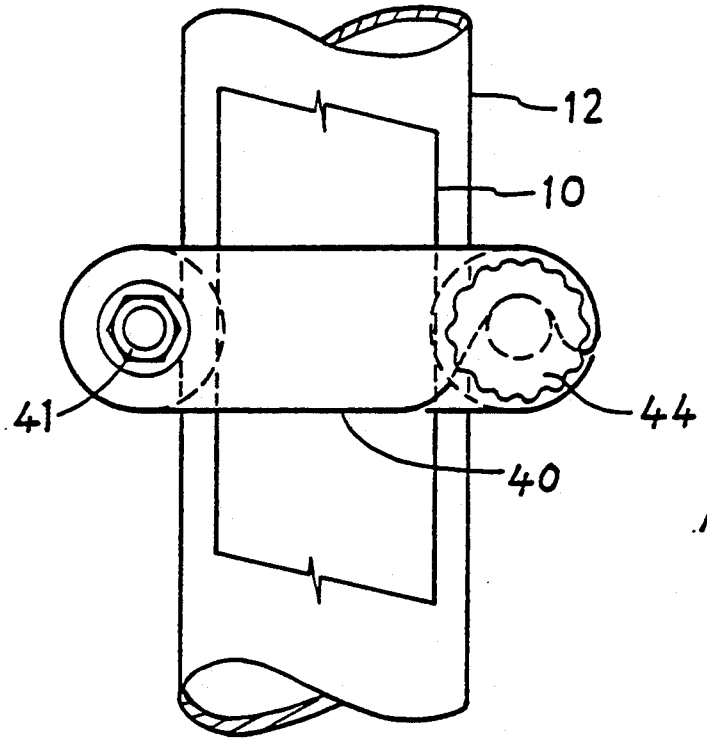

The clamp 13 of FIGS. 6 to 8 includes a base plate 30 having a recess 31 in its rearface 32 which rests against the tennis court post 12. At each end of the base plate 34. The spacer projections 33 and the corresponding portions of the clamp plate 34 have apertures therethrough for receiving the arms of a U-bolt 35 engaged around the post 12.

The first clamp plate 34 is secured to the base plate 30 by nuts 36 threaded onto the respective arms of the U-bolt 35. The first clamp plate 34 has a recess 37 for receiving the upright 10. Spaced from the first clamp plate 34 by spring 38 on arm 39 of U-bolt 35 is a second clamp plate 40 that pivots about arm 39 of the U-bolt 35. The second clamp plate 40 is held captive on arm 39 by nut 41 and when the upright is in position, the second clamp plate 40 is swung down so that the notched portion 42 engages the second arm 43 of the U-bolt 35. The upright support 10 is then clamped between the clamp plates 34 and 40 by tightening the nut 44 on the second arm 43. The mesh 46 of the tennis court passes between the spacer projections 33.

As can be seen in FIG. 1, beneath the target 21 there is a foot-mat 50 that is marked with longitudinal line 51, transverse line 52 and a series of foot marks 53. To position the mat correctly, the upright 10 is inverted (see FIG. 2) so that the target 1 is much closer to the mat. At the preferred position from the mat 50, the target 21 is just to the left of the intersection of lines 51 and 52 by approximately the diameter of a tennis ball (being 70 millimeters).

The upright 10 is then returned to its correct disposition and the player adjusts the height of the device so that at or near full stretch his racquet will strike the target 21. The player positions himself at an appropriate one of the foot marks 53 as established by reference to the directions provided with the device. When struck, the target 21 will swing away from the player in a horizontal plane and then return to its original position under the influence of the hinge piece 16. A scale 54 on the upright 10 aids the setting of the height of the device.

The device may be constructed to permit the practice of any shot in tennis or other racquet games and thus the upright 10 need not necessarily be upright and the movement of the target need not be in a horizontal plane.

Various modifications may be made in details of design and construction of the training device without departing from the scope and ambit of the invention.

I claim:

1. A device for practising a racquet shot and ball placement for a tennis serve comprising a first support member, a second support member extending from the first support member, hinge means connecting the second support member to the first support member and target means on the second support member;

said hinge means including a first mounting secured to the first support member, a second mounting secured to the second support member and a hinge piece connected between the first and second mountings, said hinge piece being a flexible planar material; the arrangement being such that when the target means is struck by a racquet, the second support member will pivot horizontally about the hinge means and then return to its original position, said first support member being a height adjustable upright, said second support member extending substantially horizontally from said upright;

a clamp for securing the upright to a post, said clamp comprising a device and further including a clamp for securing the upright to a post, said clamp comprising a base plate adapted to be positioned against the post, a U-bolt passing around the post and through the base plate, said base plate having outwardly directed spacer means for receiving a tennis court mesh therebetween, a first clamp plate mounted on the U-bolt and secured to the base plate, a second clamp plate mounted on the U-bolt spaced from the first clamp plate so as to receive the upright therebetween, and means for securing the second clamp plate to the U-bolt.

2. A device according to claim 1 wherein the flexible planar material is selected from the group consisting of polypropylene and nylon.

3. A device according to claim 1 and including recess in the rear face of the base plate contoured to receive the post.

4. A device according to claim 1 and including a spring means for biasing the second clamp plate away from the first clamp plate.

5. A device according to claim 1 and further including a foot mat adapted to be placed beneath the target to ensure correct location of the player's foot in relation to the free end of the target which is a reference point to which the player aims the ball.

6. A device according to claim 1 and further including a scale on the first support member to aid in the setting of the height of the device.

7. A device mountable on a post for practising a racquet shot and ball placement for a tennis serve comprising a first support member, a second support member extending from the first support member, hinge means connecting the second support member to the first support member, and target means on the second support member, the arrangement being such that when the target means is struck by a racquet, the second support member will pivot horizontally about the hinge means and then return to its original position, said first support member being a height adjustable upright and said second support member extending substantially horizontally from the upright; a clamp for securing the upright to a post, said clamp including a base plate adapted to be positioned against the post, a U-bolt for passing around the post and through the base plate, said base plate having outwardly directed spacer means for receiving a tennis court mesh therebetween, a first clamp plate mounted on the U-bolt and secured to the base plate, a second clamp plate mounted on the U-bolt spaced from the first clamp plate so as to receive the upright therebetween, and means for securing the second clamp plate to the U-bolt.

8. A device according to claim 7 and including a recess in the rear face of the base plate contoured to receive the post.

9. A device according to claim 7 and including a spring means for biasing the second clamp plate away from the first clamp plate.

* * * * *